United States Patent [19]

Pichette

[11] Patent Number: 5,060,441

[45] Date of Patent: Oct. 29, 1991

[54] WALL FRAME ELEMENTS WITH INSULATING PANEL ANCHORING PRONGS

[76] Inventor: Carold Pichette, 163, rue de l'Eglise, Château-Richer, Québec, Canada, G0A 1N0

[21] Appl. No.: 655,052

[22] Filed: Feb. 14, 1991

[30] Foreign Application Priority Data

Feb. 20, 1990 [CA] Canada ..... 2010500

[51] Int. Cl.[5] ..... E04B 1/62

[52] U.S. Cl. ..... 52/404; 52/715; 52/735; 52/DIG. 6; 411/466

[58] Field of Search ..... 52/404, 407, 712, 714, 52/715, 735, DIG. 6; 411/457, 461, 462, 463, 466

[56] References Cited

U.S. PATENT DOCUMENTS

| | | | |
|---|---|---|---|
| 2,047,386 | 7/1936 | Schreider . | |
| 3,196,499 | 7/1965 | Houvener . | |
| 4,512,130 | 4/1985 | Pepin . | |
| 4,761,928 | 8/1988 | Pichette | 52/404 |

FOREIGN PATENT DOCUMENTS

| | | |
|---|---|---|
| 0181854 | 9/1985 | European Pat. Off. . |
| 1258679 | 12/1971 | Fed. Rep. of Germany . |
| 2650181 | 8/1977 | Fed. Rep. of Germany . |
| 2613522 | 10/1977 | Fed. Rep. of Germany . |
| 3000975A1 | 7/1981 | Fed. Rep. of Germany . |
| 3231487A1 | 3/1984 | Fed. Rep. of Germany . |
| 541001 | 2/1977 | U.S.S.R. . |
| 240189 | 7/1988 | U.S.S.R. . |

*Primary Examiner*—Richard E. Chilcot, Jr.
*Assistant Examiner*—Wynn Wood
*Attorney, Agent, or Firm*—Pierre Lespérance

[57] ABSTRACT

Studs and plates used to retain compressible insulating panels against sagging in a hollow wall. Also, bars for securing rigid insulating panels in a wall. All of these elements are made of sheet metal and include struck-out prongs defining a similarly-shaped opening in the sheet metal. These prongs are elongated, with a pointed face end and teeth laterally projecting from one side. The inner end of each prong is integrally retained to the sheet metal and the prong can be bent into an operative position, normal to the sheet metal from an inoperative position nearly parallel to the sheet metal. A stop protrudes from the prong at the bending line to abut the sheet metal and maintain the prong in its operative position. The prong, in its inoperative position, protruding from one side of the sheet metal and offset with respect to the opening in the sheet metal, such as that it can be bent through said opening. Therefore, the user cannot bend the prong in the wrong direction.

19 Claims, 12 Drawing Sheets

15
60
56
52
59
58b
58a
40"
B
38"
54'
18
19
OS 88
76a
86
B''
29
29
76a
88
B''

62a,86
76a 92
62a,86
90
26
26

62a,86
92
90
B''

82
76
62a,86
66

82
84
B''
76
72
66
62a 66
76
72
82
62a,86
B
72

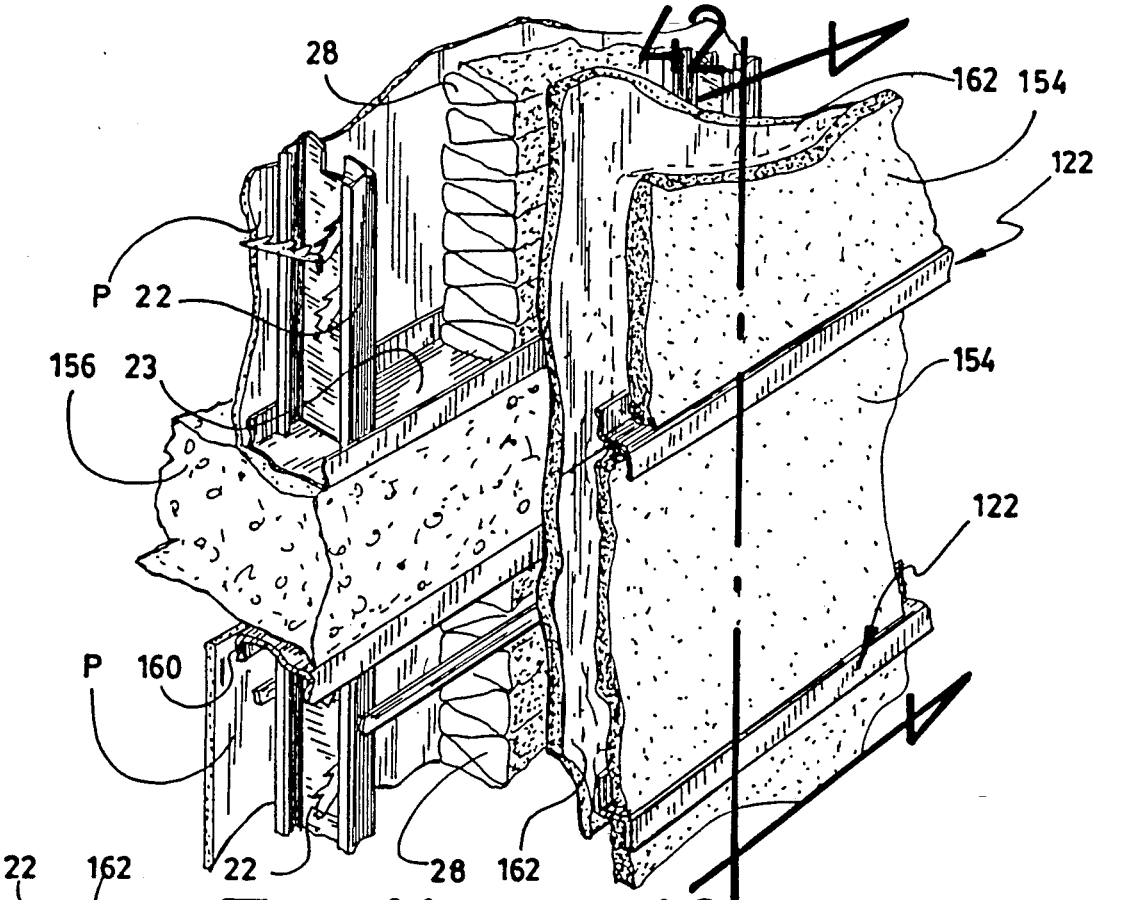
Fig. 41
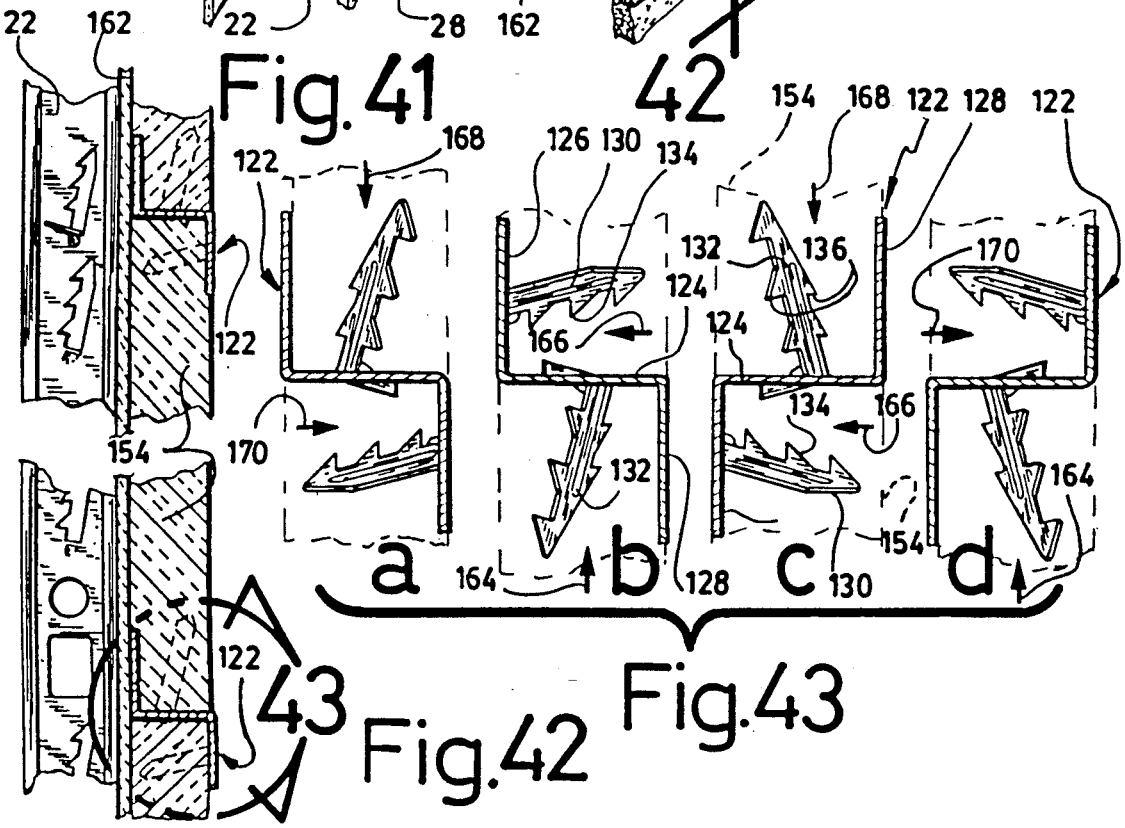
Fig. 42
Fig. 43

WALL FRAME ELEMENTS WITH INSULATING PANEL ANCHORING PRONGS

FIELD OF THE INVENTION

The present invention relates to wall structural elements with insulating panel anchoring prongs. Some of said elements serve to prevent sagging of flexible and compressible insulating panels located in hollow walls, while other elements serve to fix rigid insulating panels in a wall.

BACKGROUND OF THE INVENTION

In applicant's own prior U.S. Pat. No. 4,761,928, issued Aug. 19, 1988, a sheet metal stud serving as part of the frame of the hollow wall, is described, comprising several pairs of prongs with lateral teeth partially struck out from the web of the stud. The prongs of each pair can be bent transversely to the web alternately on each side of the same just prior to the installation of the insulating panels. Then the latter are engaged over the prongs, which prevent sagging of the panels on each side of the stud. One drawback of the patented stud is the fact that an inexperienced workman can bend all the prongs, or at least the two prongs of one or of several pairs, towards the same side of the stud web, thereby destroying the required alternating direction of successive prongs to obtain a good anchoring of the insulating panels on each side of the stud. If the workman tries to correct his error by bending back the prongs through the web opening which has resulted from the die-cutting of the prong, the retaining zone of the prong to the stud can break under the action of a second bending.

Another drawback of the patented stud relates to the possibility that the workman will set the prong to an oriented position other than its optimum anchoring position. In the above-mentioned U.S. Pat. No. 4,761,928, there are no means enabling the workman to automatically position the prong in its optimum anchoring orientation.

OBJECTS OF THE INVENTION

The principal object of the invention is therefore to provide a stud of the character described, in which each of the prongs can be bent only in one direction, the prongs capable of being bent in alternating fashion on both sides of the stud.

Another object of the present invention is to provide simple means to stop the prongs at an operative limit position normal to the stud and which is the optimum position for the anchoring and retention of the insulating panels.

Another object of the present invention relates to plates and bars used as elements of wall frames, which are provided with prongs having the above-mentioned characteristics.

SUMMARY OF THE INVENTION

In accordance with the invention, there are provided hollow wall frame elements having means for retaining against sagging, compressible insulating panels located inside the wall. These elements include studs and plates. There are also provided wall elements formed of bars used for fixing rigid insulating panels in exterior walls.

All of these elements are made of sheet metal and are provided with prongs struck out from a flat portion of the metal sheet and leaving in this flat portion an opening of the same shape as the prong. Each prong is elongated with a pointed outer end, teeth protruding from at least one side of the prong, the latter having an inner end integral with the sheet metal portion along a bending line transverse to the prong. The prong can be bent into an operative position generally normal to the sheet metal portion and on one side of the latter starting from an inoperative position nearly parallel to said sheet portion.

In accordance with a first characteristic of the invention, each prong, in its inoperative position, slightly protrudes from one of the opposite faces of said sheet portion and has a part which overlaps the edge of said aperture, whereby the prong cannot be bent through said opening, because said part will then abut against the edge of the opening.

In accordance with a second characteristic of the invention, each prong has, in the vicinity of its bending line, a boss, or stop, which protrudes from said first face and which abuts against said sheet portion in the operative position of the prong.

The sheet metal element can be a stud, or post, which is a structural element of the frame of a hollow wall. In this case, the tongues are disposed in pairs longitudinally spaced along the stud and the prongs of each pair are close to each other and in their inoperative position, protrude from opposite faces of the web of the stud and can be bent only in opposite directions on the opposite sides of the stud, in order to anchor insulating panels at regular intervals along the stud and on each side of the same.

The sheet metal elements can also be in the form of plates provided with the above-mentioned prongs, and these plates can be fixed to studs made of wood or of sheet metal. These plates can be installed on the already-existing studs of erected walls, thereby avoiding the need to dismantle the wall frame and requiring removal of the dry wall panels on only one side of the wall.

The invention is also directed to prongs provided with teeth on each side and which can be used to anchor insulating panels inserted from any side of the wall. The invention is also directed to bars used for retaining rigid insulating panels and provided with anchoring prongs.

BRIEF DESCRIPTION OF DRAWINGS

FIG. 41 is a broken perspective showing an exterior building wall incorporating Z-shaped bars in accordance with the invention, used for retaining rigid insulating panels;

FIG. 42 is a section taken along line 42—42 of FIG. 41;

FIG. 43 shows in section, in a, b, c, d four possible positions of the Z-bar, these sections being all taken within area 43 in FIG. 42;

FIG. 46 is a plan view of the Z-bar and taken along line 46 of FIG. 45.

DETAILED DESCRIPTION OF THE PREFERRED EMBODIMENTS OF THE INVENTION

Figure 1:
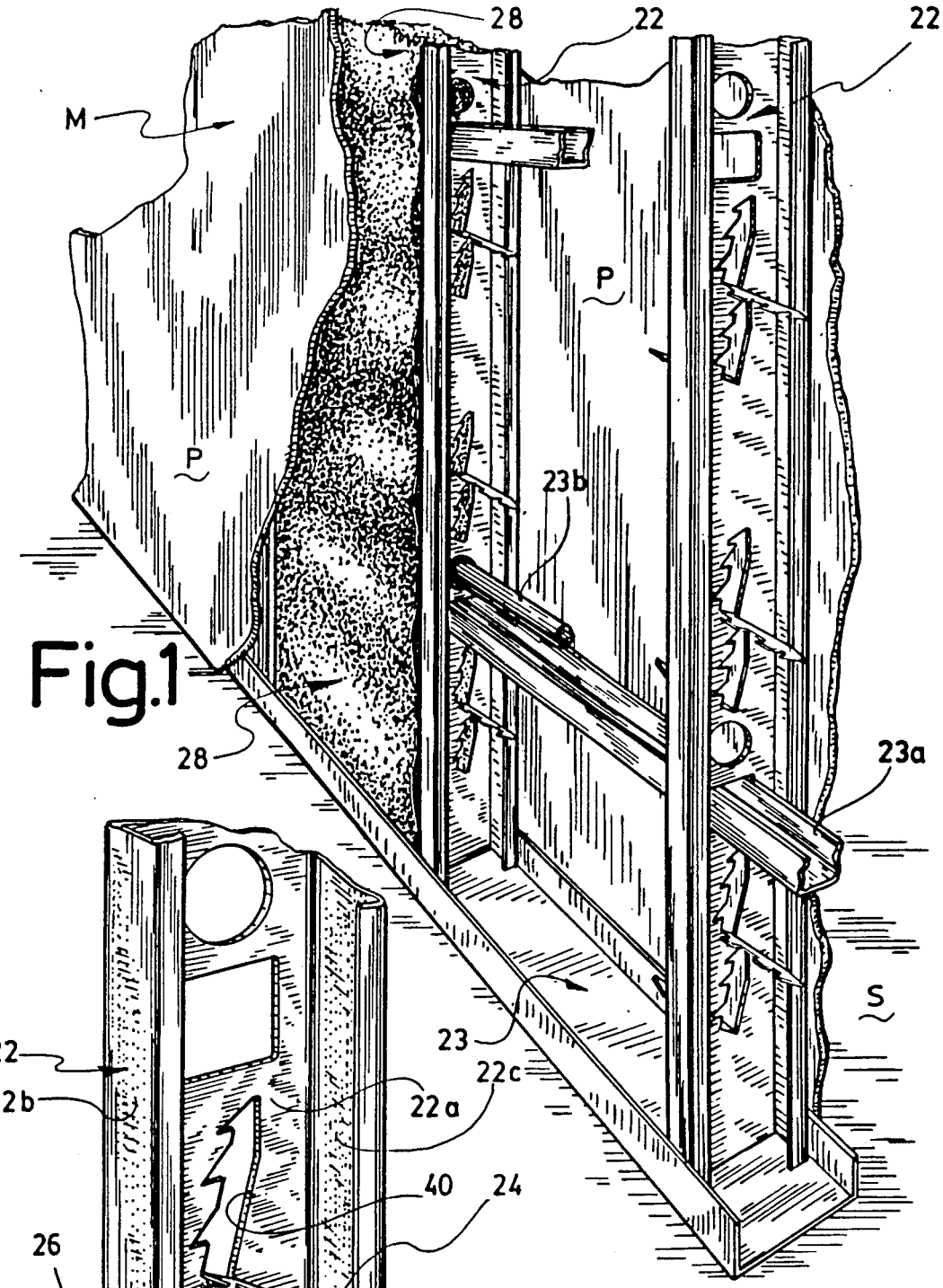
FIG. 1 a perspective view of a hollow wall broken to show the inside and with a frame including sheet metal studs with the prongs of the invention.
Figure 2:
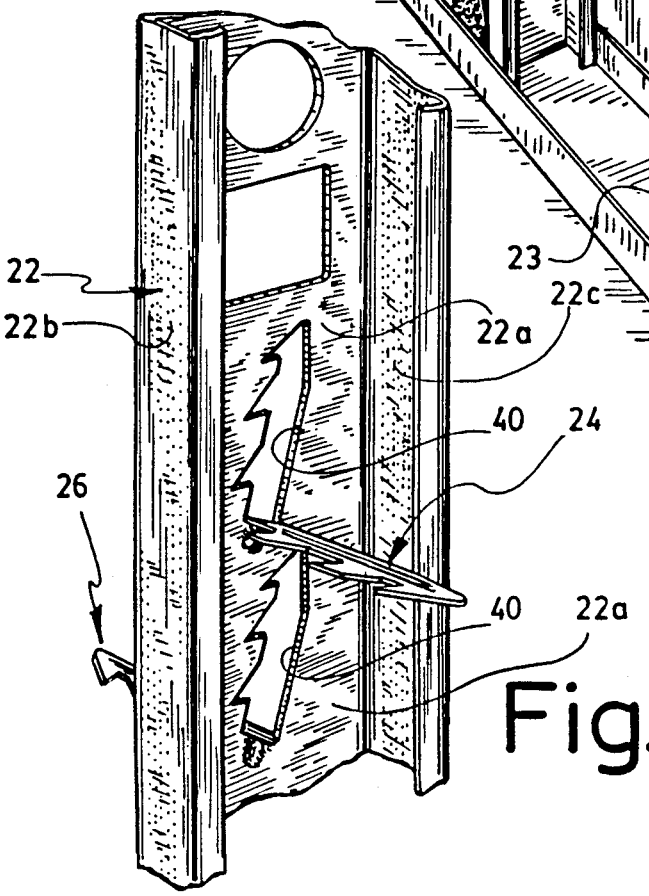
FIG. 2 a perspective view, on an enlarged scale, of the inside of the stud of FIG. 1.
Figure 3:
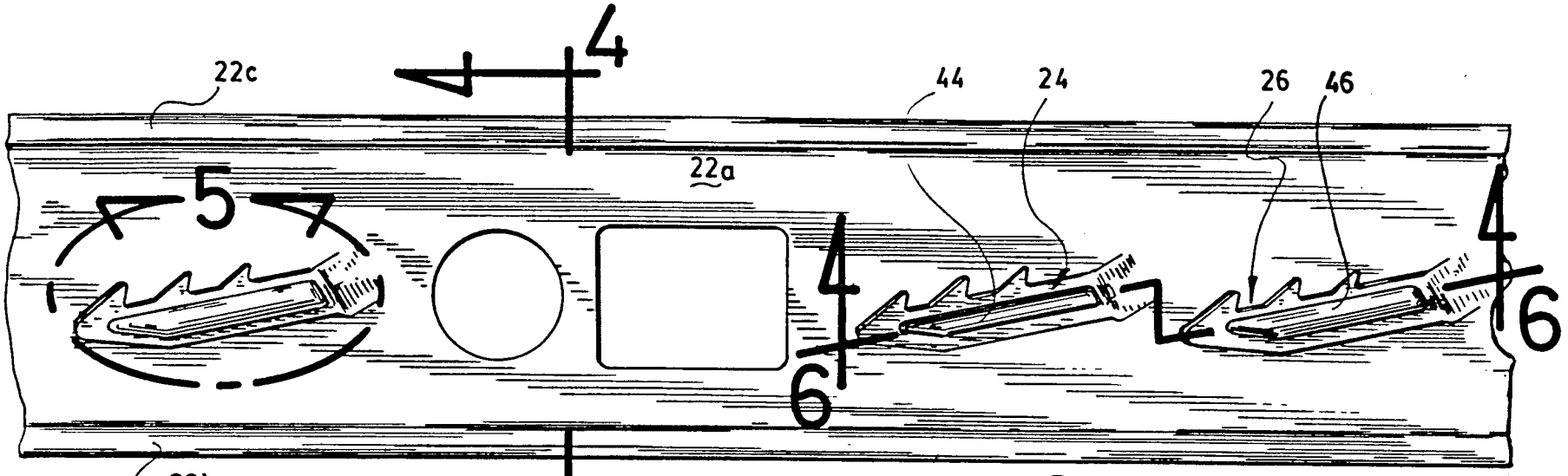
FIG. 3 is a plan view of the outside of the stud of FIG. 2.
Figure 4:
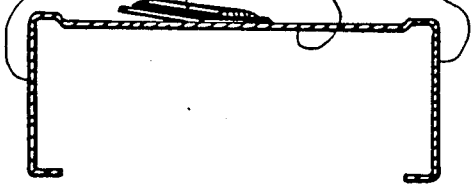
FIG. 4 is a section along line 4—4 of FIG. 3.
Figure 5:
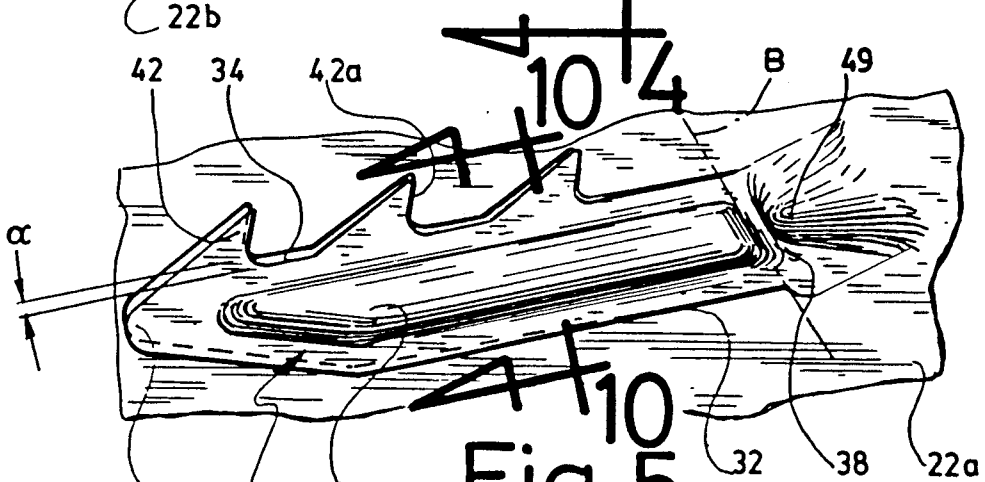
FIG. 5 is an enlarged view of the prong shown in the area delimited by ellipse 5 of FIG. 3.
Figure 6:
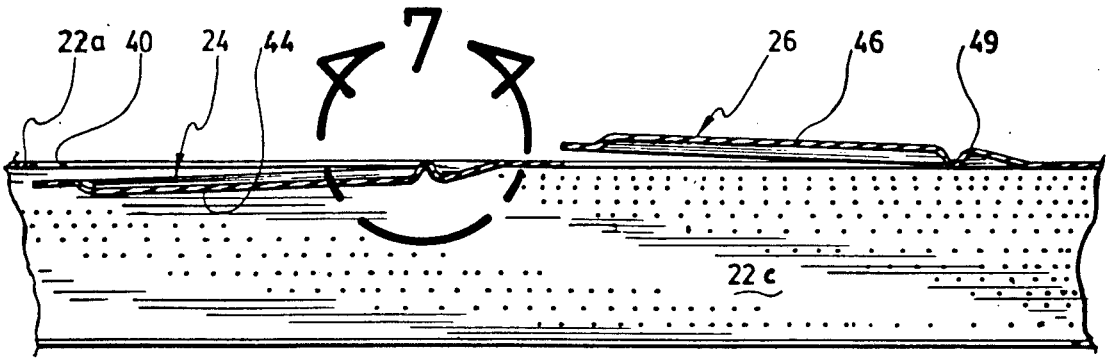
FIG. 6 is a longitudinal section taken along line 6—6 of FIG. 3.

Referring to FIGS. 1 and 2, wall M includes a rigid frame or armature made of sheet metal elements. These elements include spaced upright studs, indicated at 22, the lower end of which is inserted within and fixed to a floor channel 23 which is secured to floor S and the upper end of which, not shown, is inserted within and is fixed to a ceiling channel, not shown. Studs 22 can be reinforced by transverse bars 23A, in the form of channels, which extend through square-shaped openings of several studs 22. These studs are also provided with circular holes for the passage of conduits 23B for electric wires or for plumbing. Each stud 22 has a U-shaped cross-section and comprises a web **22*a* and two flanges 22*b* and 22*c*. Dry wall panels P are secured to the flanges 22*b*, 22*c* or to only one set of such flanges in the case it is not desired to completely close the wall. Each stud 22 is provided with a series of pairs of prongs 24 and 26, which, in their operative position, are bent at right angle with respect to web 22*a* and on each side of the latter and serve to anchor and retain flexible and compresssible panels, indicated at 28, more particularly, batts of glassfiber, which are positioned in the spaces between successive studs 22. Each prong 24 and 26 (see FIGS. 1 to 10) is obtained by partial stamping or die-cutting of the web 22*a* of the stud 22. Each prong has an elongated generally rectangular shape, with two longitudinal free sides 32, 34; an external free pointed end 36; and an internal end 38 integrally retained to the web 22*a*. Each prong 24, 26 is in an inoperative position nearly parallel to the web 22*a*. Prong 24, as shown in FIG. 6, protrudes from the inside face of the web 22*a*, namely the face exposed between the two flanges 22*b* and 22*c*, whereas prong 26 protrudes from the exterior face of web 22*a*. Each prong 24, 26 can be bent from its inoperative position, indicated hereinabove, down to an operative position perpendicular to web 22*a*, as shown, for example, in FIGS. 2, 7*a*, and 8. Each prong is pivoted to its operative position about a bending line, indicated at B in FIG. 5, which approximately corresponds to the inner ends of the die-cutting which has formed the longitudinal sides 32 and 34. The die-cutting of the prongs 24 and 26 results in the formation of correspondingly-shaped openings 40 in web 22*a***.

Figure 7:
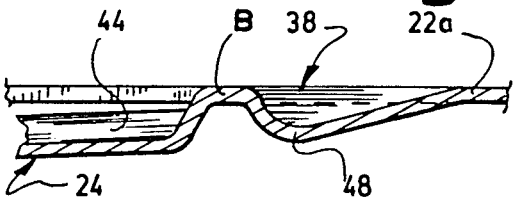
FIG. 7 is an enlarged view of the area delimited by the circle 7 in FIG. 6.
Figure 7A:
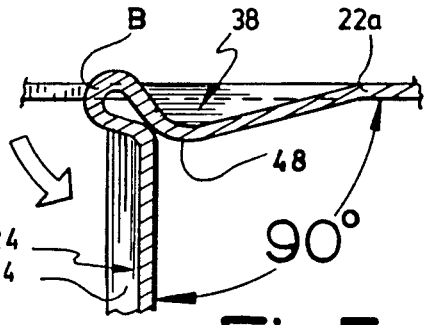
FIG. 7A is a view similar to that of FIG. 7 but showing the prong in its right angular position, namely its operative position.

The longitudinal side 32 is straight, whereas the opposite side 34 forms several teeth 42, each having a straight edge **42*a* inclined opposite tip 36. This tip facilitates insertion within insulating pane 28. Each prong 24, 26 is provided with a longitudinal central reinforcing rib 44 which protrudes from the prong on the side of the inner face of the web 22*a*, whereas each prong 26 is provided with a similar rib 46, which protrudes on the side of the external face of web 22*a*, as clearly shown in FIG. 6. The inner ends of the ribs 44 and 46 are located in the vicinity of the bending line B, which is itself in the flat part of web 22***a*. On the opposite side of the bending line B, a boss 48 or 49 is formed in the web 22*a* in alignment with the ends of the ribs 44, 46, respectively, and on the same side as the latter with respect to the plane of web 22*a*. More specifically, boss 48 protrudes on the same side as rib 44, whereas boss 49, associated with branch 26, protrudes on the same side as rib 46. In practice, the punch and die used for stamping the prong 24 operates in an opposite direction with respect to the punch and die used for stamping prong 26. The ribs 44 and 46 cooperate with the bosses 48 and 49 and abut one another in the operative position of the prong, namely the position in which the prong makes a 90-degree angle with respect to web 22*a*, as shown in FIG. 7*a*.

In accordance with a principal characteristic of the invention, means are provided to prevent prongs 24 or 26 from being bent above bending line B in a direction which would cause the prong to move through opening 40 made in web 22*a*. In the embodiment shown in FIG. 5, during die-cutting, the metal in the zone 38 and of the bending line B, is stretched unequally transversely of the prong and, therefore, the latter, once cut, is longitudinally as well laterally shifted through an angle indicated by alpha and, therefore, the prong edge 32 and the teeth 42 are shifted opposite the corresponding edges of opening 40 and makes an interference therewith.

The arrangement of the prongs 24 and 26 is as in the previously-mentioned U.S. Pat. No. 4,761,928, namely the prongs are arranged in spaced pairs longitudinally of the stud and the prongs of each pair are adjacent each other, the longitudinal axis of each prong is inclined in the same direction with respect to the longitudinal axis of stud 2, and also the bending line B is inclined relative to the longitudinal axis of prong 24 or 26; the teeth 42 of the prongs are disposed on the same side of the latter.

Therefore, in its operative position, the prong assumes a double inclination with respect to the stud. A first inclination, as shown in FIG. 8, wherein each prong is inclined towards the flange 22*b* in a plance perpendicular to the plane of the web 22*a*; and a second inclination, shown in FIG. 9, wherein each branch is transversely inclined with respect to the longitudinal axis of the stud 22.

Figure 8:
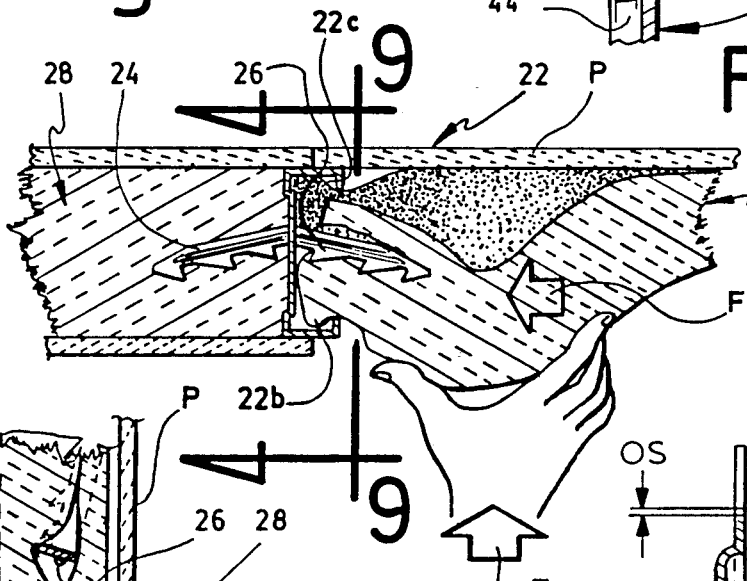
FIG. 8 is a plan section of a part of the wall showing how an insulating panel is anchored.
Figure 9:
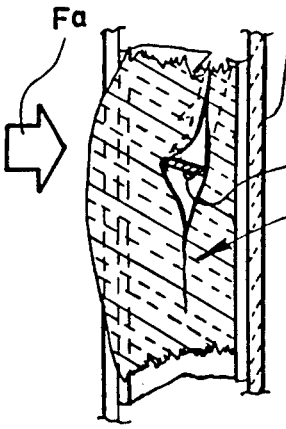
FIG. 9 is a section taken along line 9—9 of FIG. 8.
Figure 10:
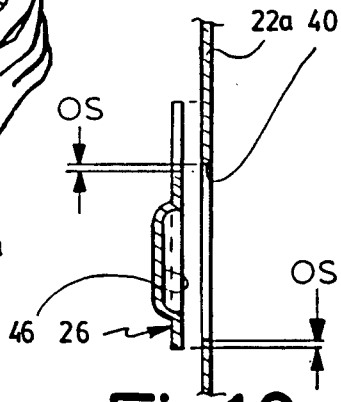
FIG. 10 is a section on an enlarged scale, taken along line 10—10 of FIG. 5.

In practice, to install insulating panels, especially batts of glassfibers 28 within hollow walls, one proceeds as shown in FIGS. 8 and 9. The prongs 24 and 26 must be oriented towards the workman, that is towards the side of the wall where the dry wall panel P is not yet in position, and it is necessary that the teeth 42 be directed towards the workman, that is towards the open side of the wall; and that the teeth be directed upwardly, as shown in FIG. 9. It is then very easy to position the insulating panel 28 by pushing its side edge against the pointed tips of the prongs in accordance with arrow F of FIG. 8 and by a nearly simultaneous movement, pushing the insulating panel 28 against the already-installed wall panel P, in accordance with arrow Fa of FIGS. 8 and 9.

The prong inclination towards the workman not only facilitates anchoring the panels 28 but also causes the prongs 24 and 26 to pierce several easily-detachable glassfiber laminations of the panel 28, these laminations being generally parallel to the wall panels P. A better retention of the glassfibers against sagging is obtained. The retention is still improved because the glassfiber batts under their weight tend to slip towards the back in the direction of arrow Fa of FIG. 9 to finally rest against the right-hand panel P of FIG. 9.

If the workman has made sure to install the studs 22 with the tips of the prongs 24 and 26 in their inoperative position directed upwardly, as shown in FIGS. 1 and 2, and that he has first fixed the dry wall panels P against the flanges 22*c* of the studs 22 opposite the direction of the teeth 42, it will then be impossible for him to make a mistake in choosing the proper bending direction of the tongues 24, 26 of each pair, since these tongues can only be bent in the proper direction. Also, the optimum operative position is obtained, namely at 90 degrees with respect to the web 22*a*, by simply bending the tongues until they attain their limit position, where, as shown in FIG. 7*a*, the inner end of reinforcing rib 44 or 46 abuts against boss 48 or 49. Also, due to these stopping means, the prongs will not tend to move downwardly with time under the weight of the glassfiber panels 28.

Figure 11:
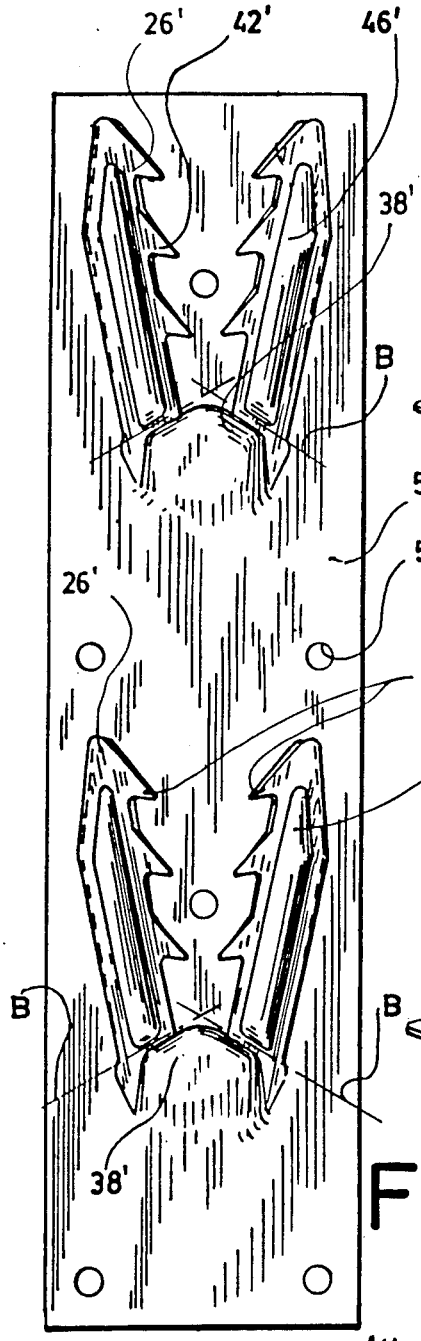
FIG. 11 is an elevation of a plate provided with anchoring prongs.
Figure 12:
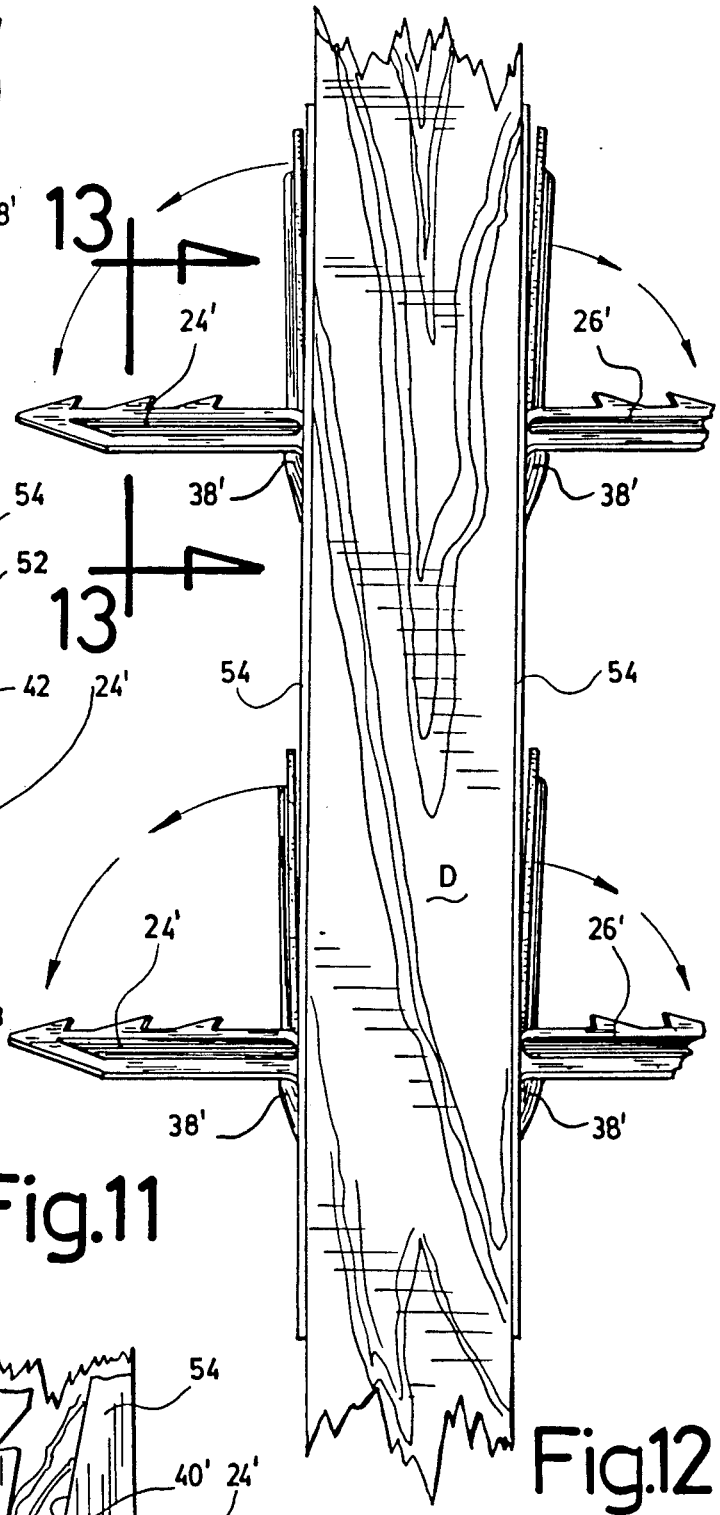
FIG. 12 is a side elevation of a wooden stud to which two plates in accordance with FIG. 11 are secured.
Figure 13:
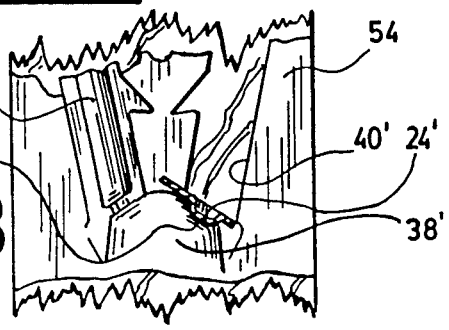
FIG. 13 is a section taken along line 13—13 of FIG. 12.

FIG. 11 and 13 show a rectangular plate 54 provided with holes 52 to fix the plate by nails or the like to each of the two opposite faces of a wooden stud or upright D (FIG. 12) or to each of the opposite faces of the web of a conventional sheet metal stud when the latter is made of a thicker than normal metal sheet and which will not permit bending of the prongs without the use of a tool. Plate 54 is provided with two pairs of prongs 24' 26'. The prongs of each pair are at the same level and diverge in the direction of their tip. It is only the longitudinal internal side of each prong which is provided with teeth 42', similar to teeth 42, and which face one another in the inoperative position of the prongs. Each prong 26' is provided with a rib 46', the inner end of which is in the vicinity of bending line B, whereas a boss 38' is provided on the other side of the bending line, said bosses being common to the two prongs 24' 26'. In their inoperative position, all of the prongs 24' 26' slightly protrude from the external face of the plate 54. Boss 38' and also the ribs 46' also protrude from the exterior face of plate 54. A plate 54 is secured to each of the opposite faces of wooden stud D, with the pointed tips of the prongs 26' upwardly directed and with the prongs on the outside of the stud. The workman selectively bends that one of the prongs 24' and 26' of each pair, the teeth 42' of which are directed towards himself and upwardly inclined in the same direction as was described with respect to FIGS. 8 and 9. The prongs cannot be bent other than in the external direction of the plate, because the prongs are laterally and longitudinally offset with respect to the opening 40' formed in the plate by the die-cutting of the prongs. The prongs are positively maintained in their operative position normal to the plate 54.

Figures 14, 15, 16, 17, 18, 19:
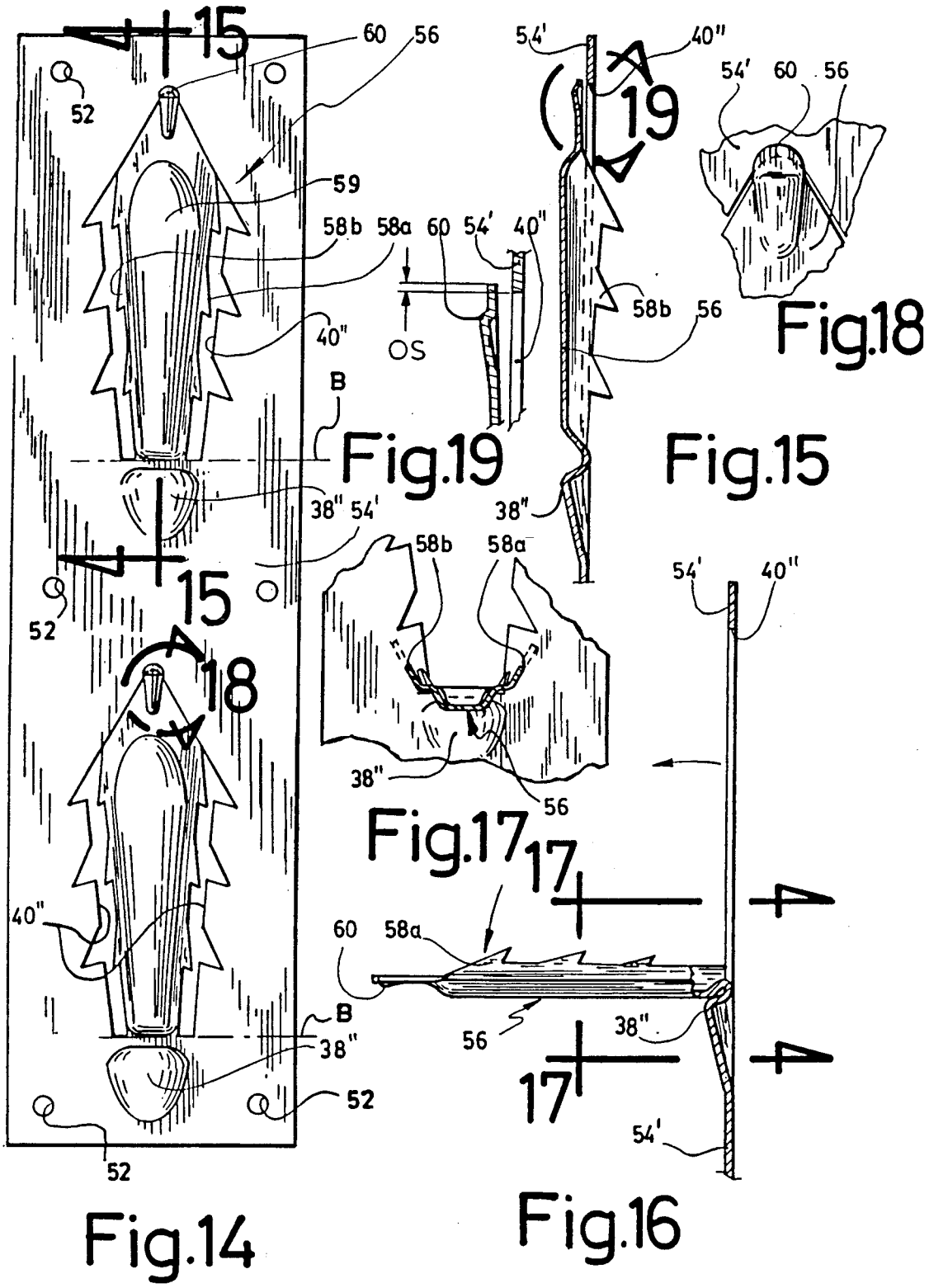
FIG. 14 is an elevation of a plate provided with another embodiment of the prongs in accordance with the invention.
FIG. 15 is a partial section taken along line 15—15 of FIG. 14.
FIG. 16 is a view similar to that of FIG. 15, but showing the prong in its bent operative position.
FIG. 17 is a section taken along line 17—17 of FIG. 16.
FIG. 18 is an enlarged view of the area within circle 18 in FIG. 14.
FIG. 19 is an enlarged view of the area within circle 19 of FIG. 15.

FIGS. 14 to 19 show a plate 54' which is positioned in the same manner as plate 54 on the opposite faces of either a wooden stud D or of the web of a conventional sheet metal stud. Plate 54' has holes 52 for securing the same. Each pair of prongs 24' 26' is replaced by a single prong 56, having a series of teeth 58*a*, 58*b* on each of its two longitudinal sides and which is also provided with a central longitudinal reinforcing rib 59, the inner end of which is adjacent the bending line B'. Plate 54' has a boss 38'' on the opposite side of the bending line. The width of the prong 56 decreases in the direction of its bending line, except its pointed end portion. This pointed end is provided with an extension 60, in the form of a boss, which overlaps a distance OS the corresponding edge of opening 40'' which was formed during die-cutting of the prong 56. The extension 60 prevents the prong from being bent through the opening 40''. The sides of the prong and the teeth 58*a* and 58*b* are diverging and inclined with respect to plate 54'. In the inoperative position of the prong 56, teeth extend through opening 40'', as shown in FIG. 15. In its operative position shown in FIGS. 16 and 17, prong 56 is maintained in its horizontal position normal to plate 54' by a boss 38'' and by the abutting inner end of rib 59. As for plate 54, it is not necessary to choose which side of the hollow wall is to be left open for installation of the insulating panels, since there is always one series of teeth which face the workman. Moreover, these teeth are upwardly inclined towards the workman, as in FIG. 8, and also because the prongs decrease in width, the teeth are inclined towards the workman in a plane perpendicular to the plane of the plate 54' in a manner similar to the teeth of the prongs 24 and 26 in FIG. 8.

Prongs 56 are all bent on the same side to extend outwardly of plate 54' in their operative position.

Figure 20:
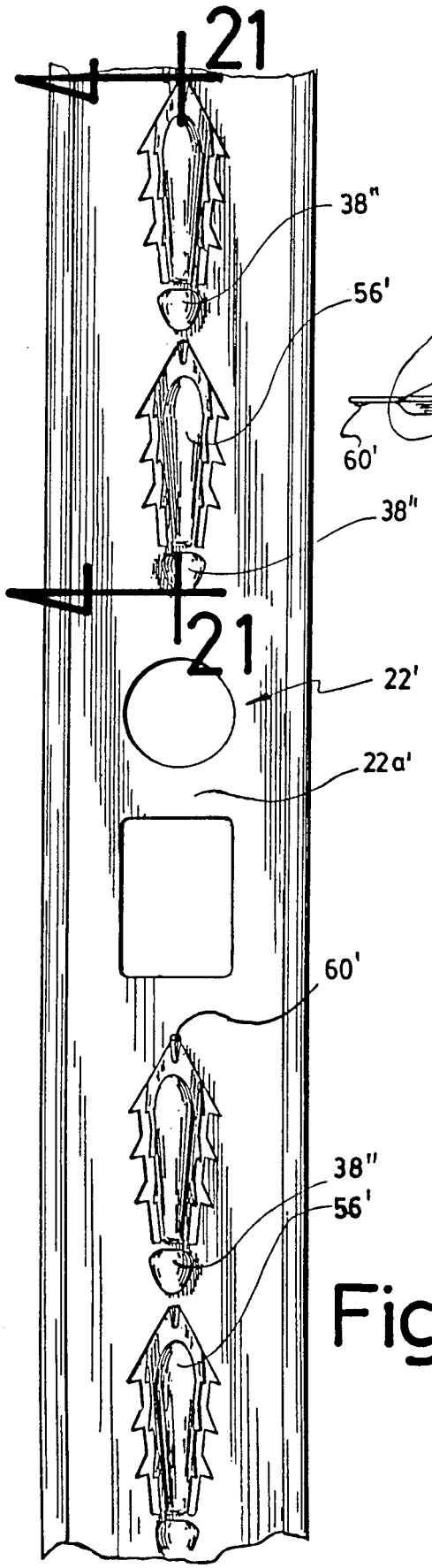
FIG. 20 shows a stud having prongs in accordance with FIG. 14.
Figure 21:
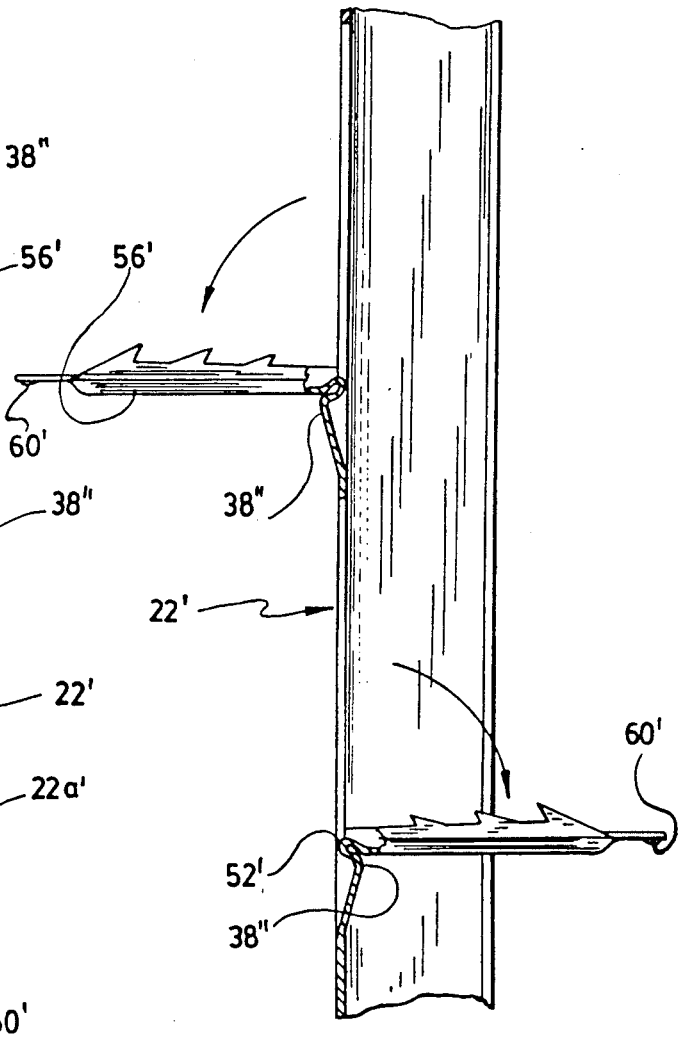
FIG. 21 is a partial section taken along line 21—21 of FIG. 20.

The same type of prongs is shown in FIGS. 20 an 21, wherein they are used in association with a stud 22' analogous to the stud 22 of FIGS. 1 and 11. In this latter , prongs 54' are arranged in pairs, the prongs of each pair being adjacent to each other and the prongs of the same pair capable of bending in opposite directions only (FIG. 21) and are maintained normal to the web of the stud by means of the reinforcing ribs of these prongs together with the bosses 38'', as in the plate of FIG. 14. Prongs 56' are also provided with extensions 60' to prevent them from being bent through the corresponding opening in the stud web. Therefore, the workman will be obliged to pivot the prongs 56' in alternate manner on each side of the stud. The stud provided with prongs 56' has the same advantage as those defined in relation with prongs 56 of plate 54' of FIG. 14.

FIGS. 22 to 27 show a sheet metal stud 62 provided with longitudinally-spaced groups of two pairs of prongs. The prongs of the first pair are indicated at 64 and 64*a*,, while the prongs of the second pair are indicated at 66 and 66*a*. The prongs of each pair are arranged in a manner analogous to the prongs 26' of FIG. 11. Prongs 64 and 64' can be bent only towards the inside of the stud 62, while the prongs 66, 66*a* can only be bent towards the exterior of the stud 62. More specifically, the prongs of the same pair are disposed azt the same level along the stud 62. They are diverging towards their pointed end 68 and their inner ends are defined by the respective bending lines B''. Each prong of the same pair has a series of teeth 70 on its inner side and which face the other prong of the same pair. The prongs are laterally offset during die-cutting, such that the edge of opening 72 resulting from the die-cutting of the prong will interfere with the corresponding prong.

Figures 22, 23, 24:
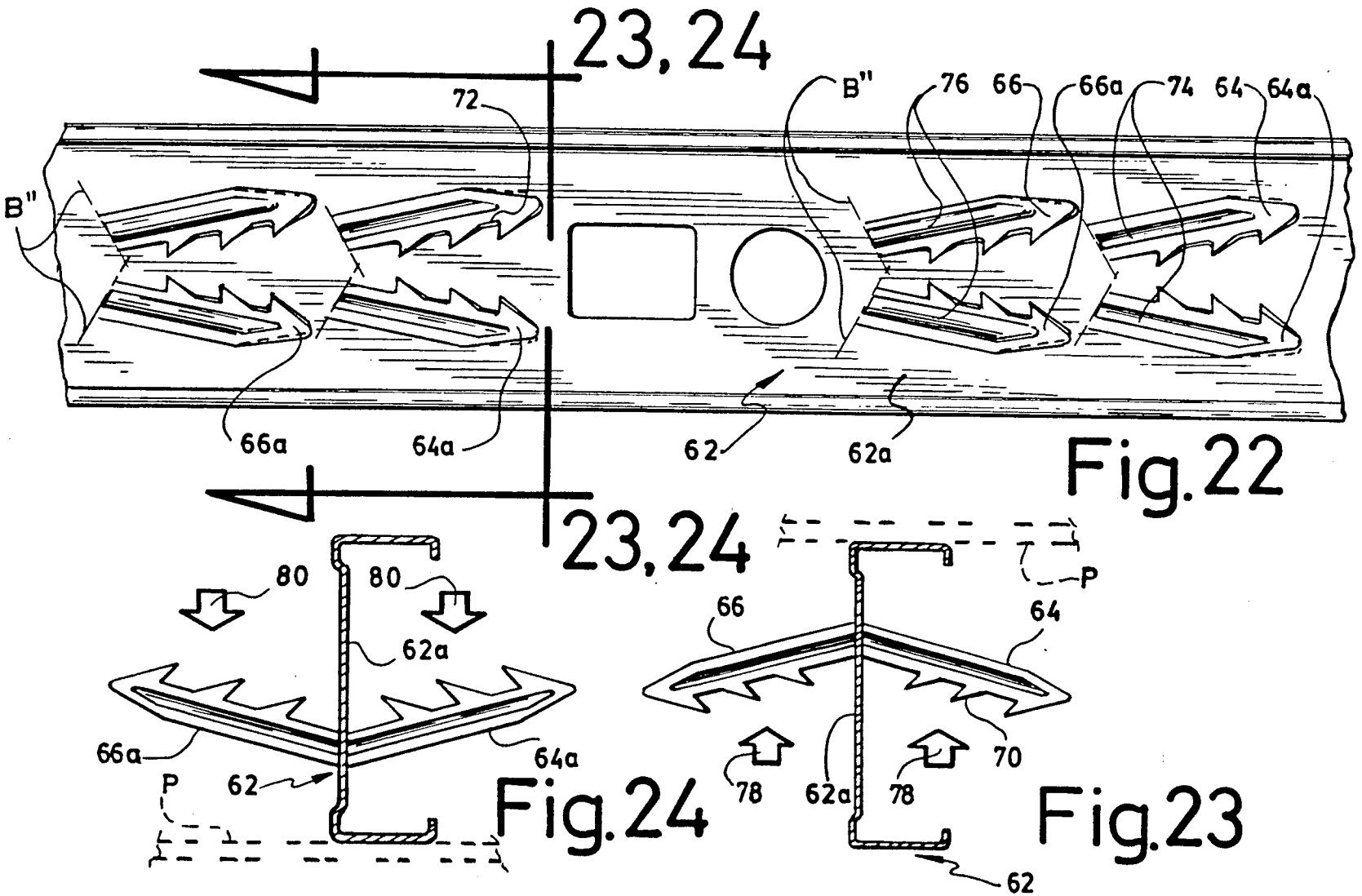
FIG. 22 is an elevation of a stud provided with another prong arrangement serving to retain insulating panels.
FIGS. 23 and 24 are sections taken along line 23-24, 23-24 of FIG. 22 two ways of bending the prongs.

Referring to FIG. 22, prongs 66 and 66*a* protrude from the exterior face of web 62*a* in their inoperative position, while prongs 64, 64*a* protrude from the inside face of the same web 62*a*. In the same manner, reinforcing ribs 74 of prongs 64, 64*a* are recessed with respect to the exterior face of web 62*a*, while the reinforcing ribs 76 of prongs 66, 66*a* protrude from said external face. If the insulating panels are to be inserted in the direction of the arrow 78 (FIG. 23), the workman will bend the superposed prongs 64, 66 to their operative position, such that their teeth 70 will face the workman and with the prongs laterally inclined towards the latter, as in FIG. 8. If the insulating panels are to be installed from the opposite direction, as shown by arrows 80, (FIG. 24) the workman will then only bend the prongs 64*a* and 66*a*.

Figures 25, 26, 27, 28, 29, 30, 31:
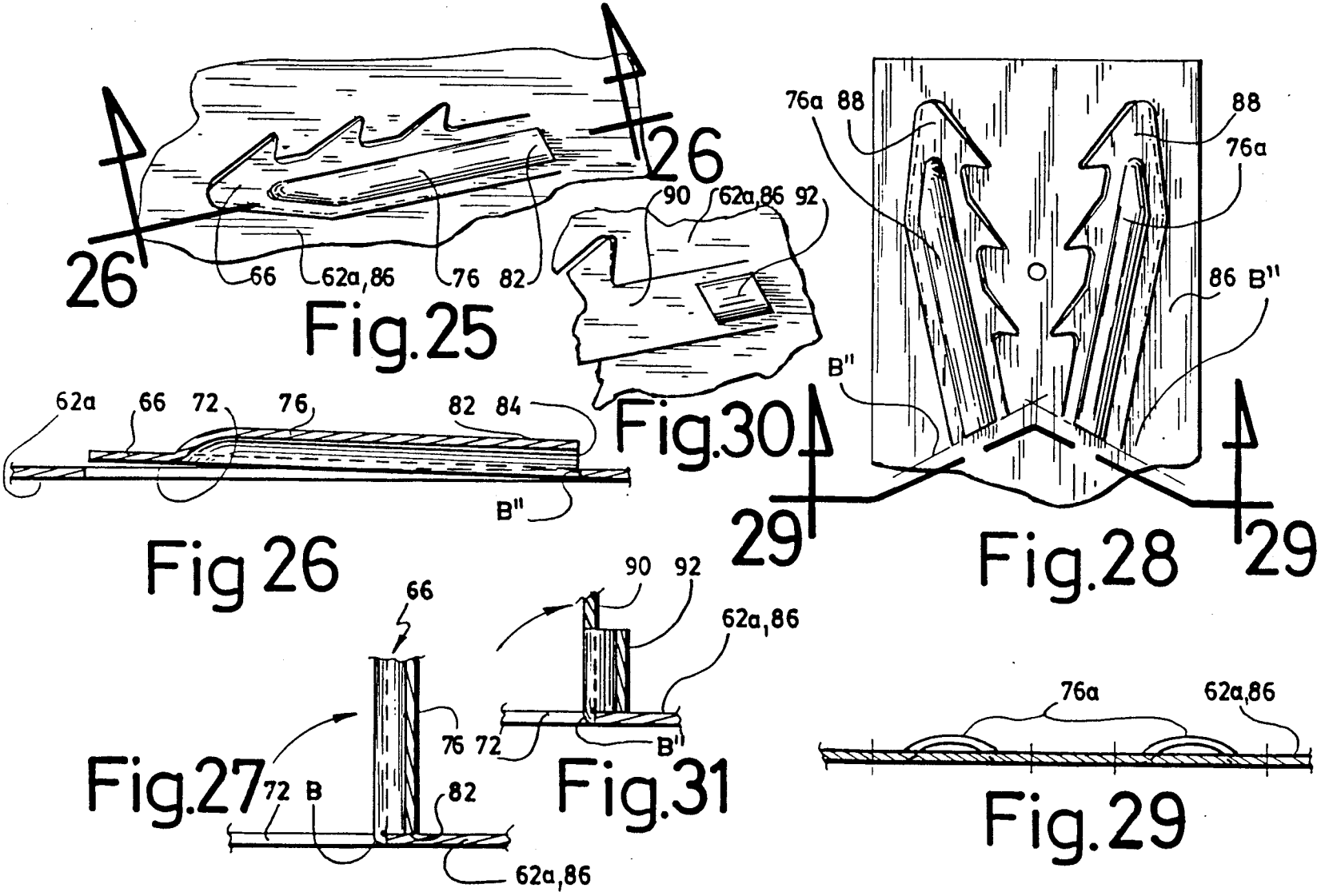
FIG. 25 is a plan view of a portion of the stud of FIG. 22, showing a prong on an enlarged scale.
FIG. 26 is a section taken along line 26—26 of FIG. 25.
FIG. 27 is a section similar to that of FIG. 26, but showing the prong in operative position.
FIG. 28 is a partial elevation of a plate provided with the prongs of FIG. 25.
FIG. 29 is a section taken along line 29—29 of FIG. 28.
FIG. 30 is a partial view showing the prong of either FIG. 25 or FIG. 28, but provided with a modified stop.
FIG. 31 is a view similar to that of FIG. 30 but showing the prong in operative position.

Referring to FIGS. 25 to 27, each reinforcing rib 74 or 76 extends centrally of the prong and its inner end 82 is open at 84 at the level of the bending line B''. This inner end forms a stop for maintaining the prong in operative position at 90 degrees with respect to the web 62*a*, as shown in FIG. 27. In this case, it is not necessary to form a boss on the web on the other side of the bending line B''.

FIGS. 28 and 29 show a plate 86, similar to the plate of FIG. 11, and which has the same purpose. It is provided at two different levels with pairs of prongs 88, which are similar to prongs 26' of FIG. 11, except that the stop means for maintaining the prongs in their operative 90-degree position. These stop means consist of ribs 76*a* outwardly protruding from the outside of the plate and the inner end of which abuts against the plate 86 in the operative position of the prong. A hole 84 is formed at the inner end of rib 76*a*.

FIGS. 30 and 31 show a prong 90 provided with a stop 92 which ends at the level of the bending line B'' as for the prongs 88 of FIG. 28, but these stops 92 are much shorter than reinforcing ribs 76*a* and are open at both ends. The stop 92 is used when the metal sheet is sufficiently thick as to obviate the necessity of having reinforcing ribs in the prongs 90. Stop 92 directly abuts against the plate 62*a* or 86 in the operating position of the prong, as shown in FIG. 31. Such a prong 90 can be used not only for plates but also for the webs of metallic studs.

Figure 32:
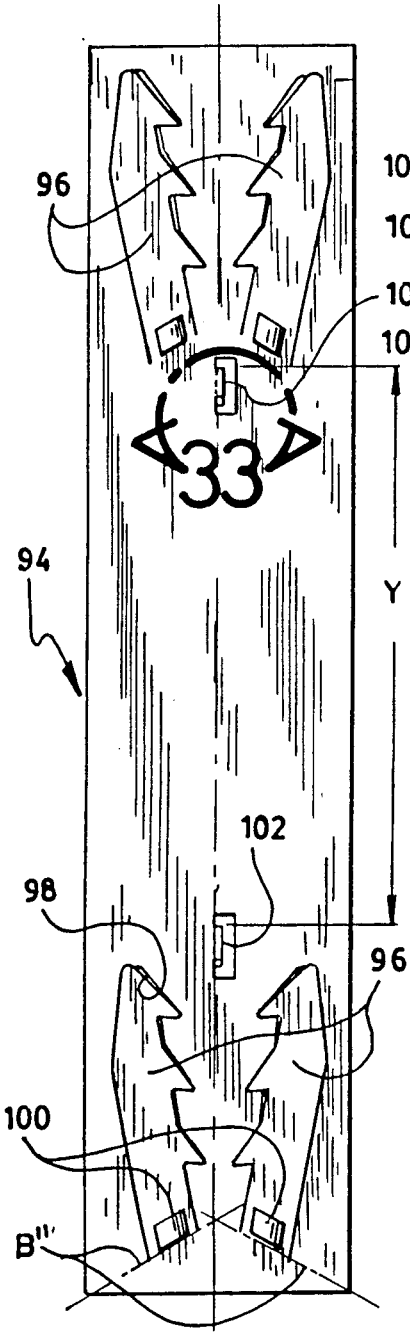
FIG. 32 is an elevation of a plate provided with the prongs of FIG. 30 and provided with hooks to fix the plate to a sheet metal stud.
Figure 33:
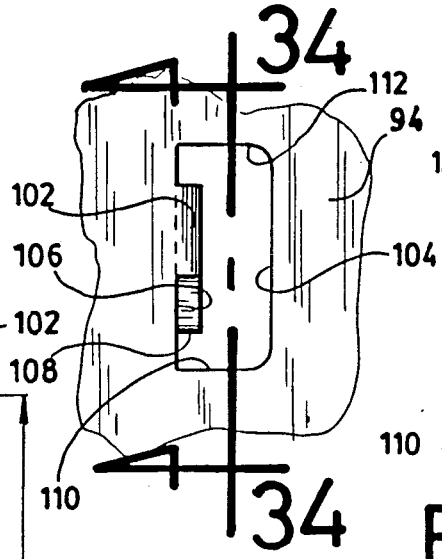
FIG. 33 is an enlarged view of the area in circle 33 of FIG. 32.
Figure 34:
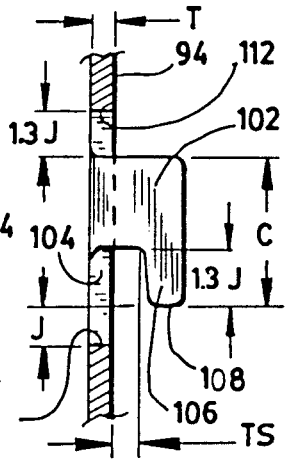
FIG. 34 is a partial section taken along line 34—34 of FIG. 33.

FIG. 32 shows a plate 94 provided with prongs 96 disposed in diverging pairs, as in the plate 54 of FIG. 11. Plate 94 has the same purpose as plate 54. Each prong is laterally shifted to prevent its passage through opening 98 of the plate. Each prong 97 is provided with a stop 100, identical to stop 92 of FIG. 29. Prongs 96 can be bent along the bending lines B''. Plate 94 is characterized by the provision of two hooks 102 spacedly disposed along the centerline of the plate 94. These hooks are bent back to protrude from the internal face of the plate 94 and are partially die-cut within an opening 104 formed in the plate during die-cutting of the hooks 102. Each hook has a downward leg 106, the height of which is equal of 1.3 times the distance J between the lower end 108 of the leg 106 and the lower edge 110 of the opening 104. The top edge 112 of opening 104 is equal to the height of the leg 106, that is to 1.3 times J.

Figure 35:
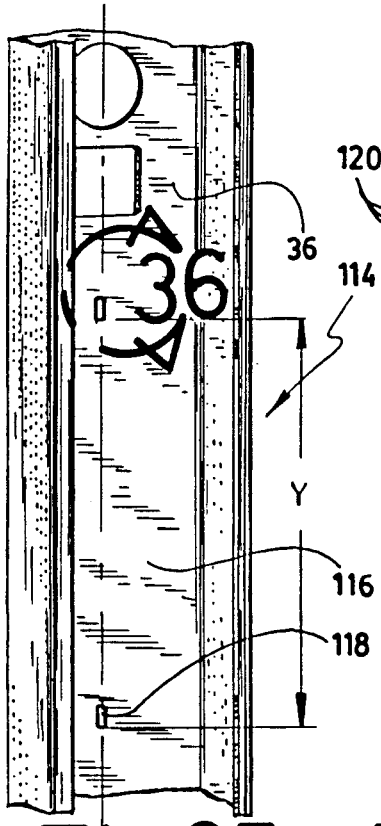
FIG. 35 is a perspective view of a sheet metal stud provided with holes to receive the hooks of the plate of FIG. 32.
Figure 36:
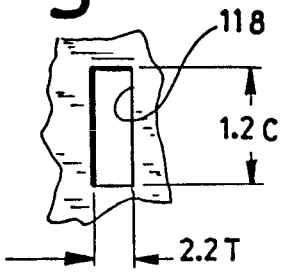
FIG. 36 is an enlarged view of the area 36 in FIG. 35.

A conventional sheet metal stud 114, shown in FIG. 35, is characterized by the fact that its web 116 is provided with pairs of rectangular holes 118 spacedly disposed along the centerline of web 116 a distance from each other indicated by Y and which is equal to the distance Y between the hooks 102 of the plate 94. These holes 118 are rectangular and, as shown in FIG. 36, their width is approximately equal to 2.2 times the thickness T of plate 94, while the height of hole 118 is equal to about 1.2 times the total height C of hook 102.

Figure 38:
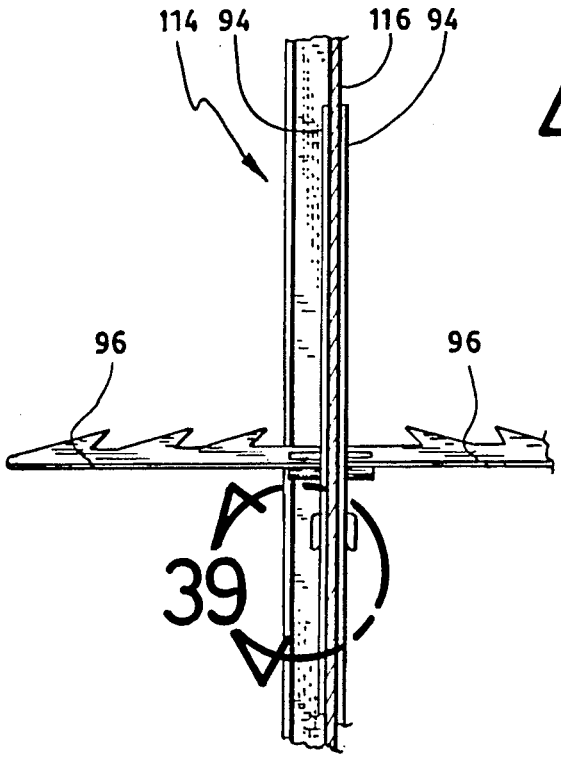
FIG. 38 is a partial vertical section of the stud of FIG. 35 to which is secured the plate of FIG. 32 on each of its two sides.
Figure 39:
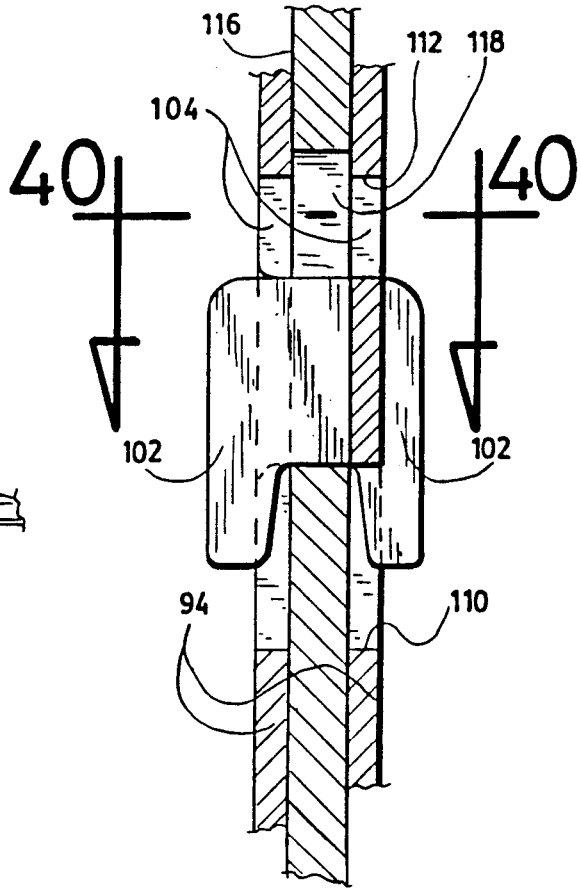
FIG. 39 is an enlarged section taken within area 39 of FIG. 38.
Figure 40:
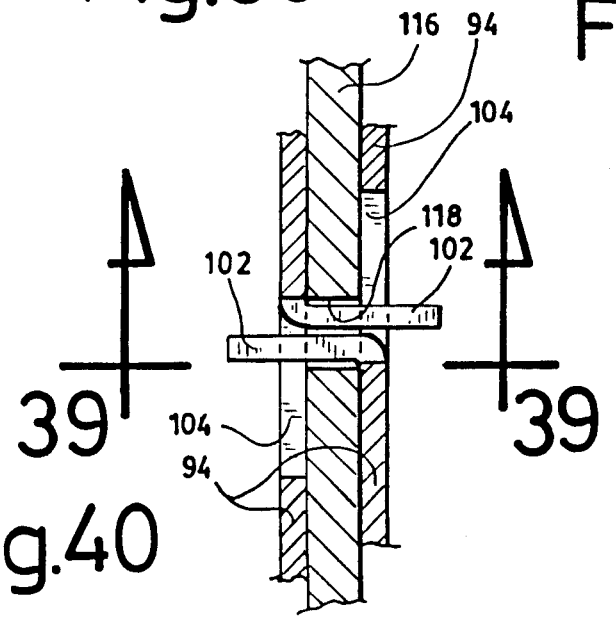
FIG. 40 is a section taken along line 40—40 of FIG. 39.
Figure 45:
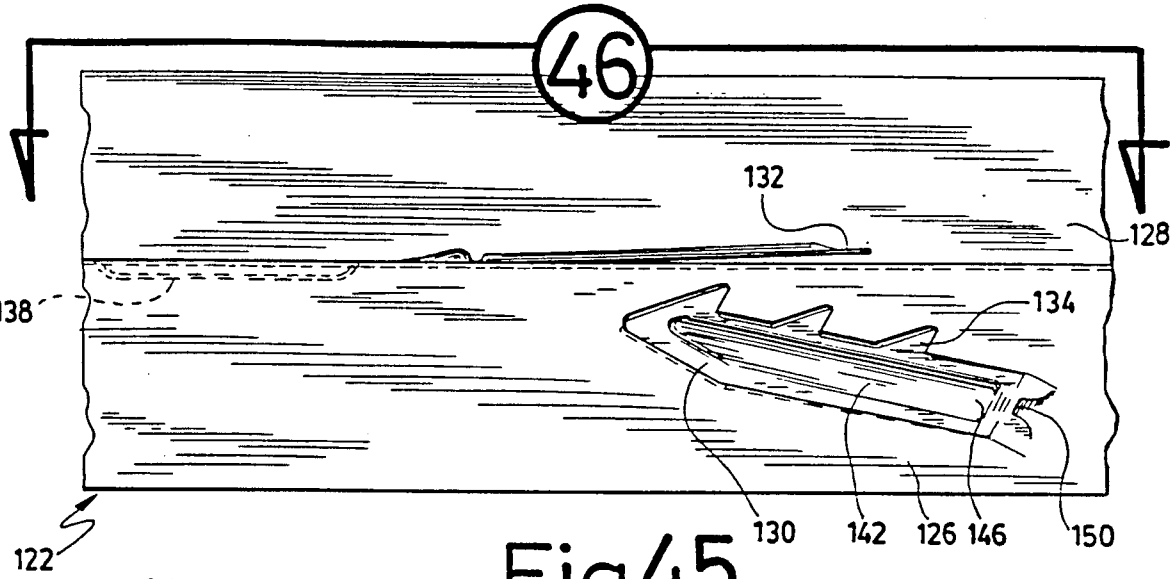
Figure 46:
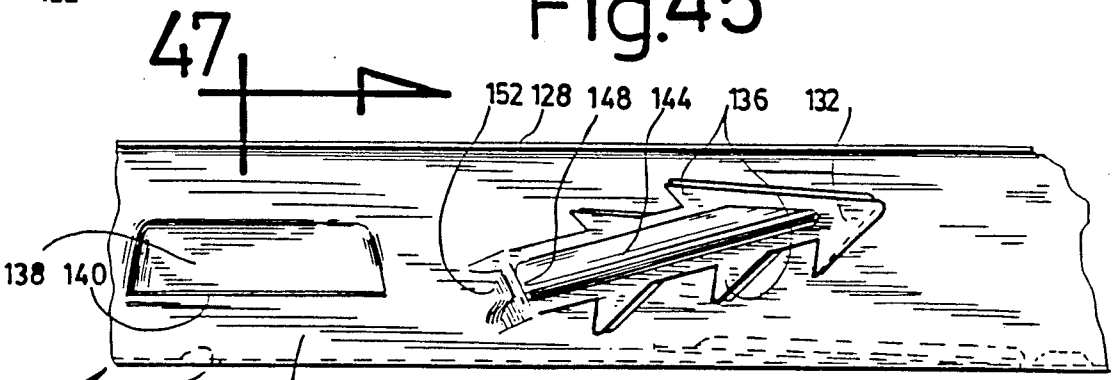
FIG. 46 is a partial elevation of the Z-bar, taken along line 45—45 of FIG. 44.
Figure 44:
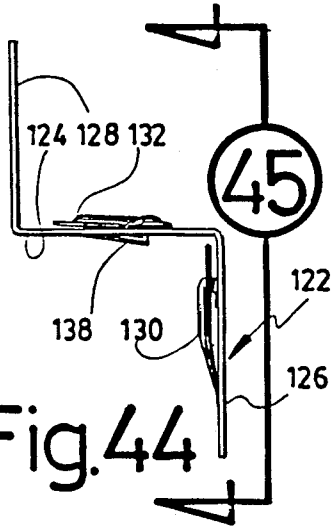
FIG. 44 is an end view of the Z-bar.
Figure 47:
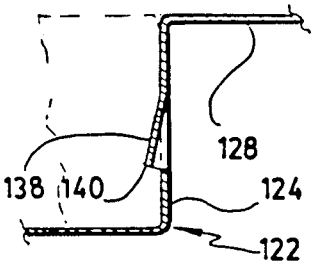
FIG. 47 is a section taken along line 47—47 of FIG. 46.

As shown in FIGS. 38 and 40, two plates 94 can be positioned back to back on each side of the web 116 with their hooks 102 disposed side by side and extending through a common opening 118 and through the opening 104 of the other plate 94. The height of all these openings is sufficient for insertion of a hook while the plate is in raised position and to allow the subsequent lowering of the plate for the hook leg to engage the opposite face of the web 116 of the stud 11.

Figure 37:
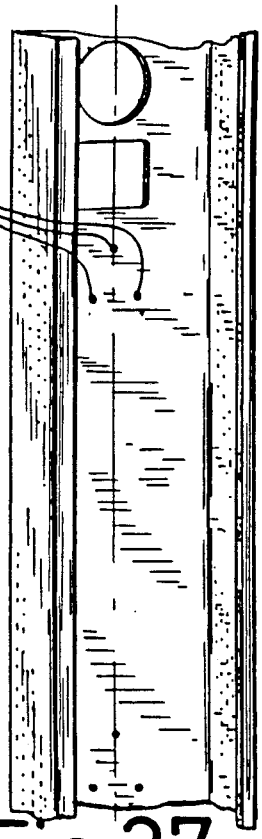
FIG. 37 is a perspective of a conventional metal stud provided with holes for fixing plates similar to that of FIG. 28.

FIG. 37 shows a conventional stud 119, made of sheet metal and similar to stud 114, but in which the openings 118 have been replaced by round holes 120, which can be made on the building site or at the stud manufacturing plant and which serve to fix anchoring plates, such as plates 54 of FIG. 11, in opposite directions by means of metal screws.

FIGS. 41 to 46 show a wall structural element 122, which is a bar of Z-shape cross-section, adapted to be positioned horizontally. This bar is formed by a central web 124 and two flanges 126, 128 at right angles to the web and oppositely directed. Web 124 and flange 126 are each provided at uniform distances along the bar, with prongs 130 and 132 respectively. Prongs 130, which are obtained by die-cutting the flange 126, are very similar to prongs 24, 26 of FIGS. 1 to 11. They are provided with teeth 134 on only one longitudinal side. Prongs 122, which are die-cut in web 124 are similar to prongs 132, except that they re provided with teeth 136 on both sides of the prong. Prongs 130, 132 are laterally and longitudinally offset during die-cutting, such as to interfere with the edge of the opening formed during die-cutting. Prongs 130 and 132 can therefore be bent towards or only one side of the web or of the flange. Prongs 132, made in web 124, can only be bent to their operative position in a direction opposite to a boss 138 formed in web 124 by die-cutting and which provides a sharp edge 140 facing flange 126, that is the flange provided with prongs 130. Each prong 130, 132 is provided with a central longitudinal reinforcing rib 141, 144, the inner end 146, 148 of which abuts against a boss 150, 152 in the operative position of the prong, in order to positively maintain the latter in a plane perpendicular to web 124 and to flange 126 respectively.

FIGS. 41 and 42 show how the bar 122 is used. It serves to retain in position rigid insulating panels 154 used in external building walls. These rigid panels are generally made of polyurethane foam or of compressed glass fibers. FIG. 41 also shows the inside of the wall, including the insulating panels 28 of non-compressed glass fibers and which are flexible and compressible. These panels 28 are located between studs 22. The interior side of the exterior wall is finished by dry wall panels P.

FIG. 41 shows a concrete floor 156 of a building with the studs 22 inserted within a floor channel 23 secured to the floor and inserted within a sealing channel 160. The exterior edge of floor 156, as well as the exterior of the hollow wall, is covered by rigid insulating panels 162 to which are secured the horizontal Z-bars 122. The vertical distance between the various Z-bars 122 is equivalent to the height of the panels 154, the latter having standard dimensions.

In the position of the bar 122, shown in FIG. 41 and also in FIG. 43-*b*, flange 126, provided with prong 130, is directed upwardly and directly fixed to the panels 162. Panel 154 is installed from the external side of the wall first by inserting the top edge of the panel 154 between the flange 128 and the panel 162 and by raising the panel in accordance with arrow 164, such that it will be anchored by prongs 132, having a double set of teeth. The lower edge of the panel is simply pushed against the prongs 130 of flange 136 in the direction of arrow 166 and the lower edge portion of the panel is hooked not only by the prong teeth 134 but also by the retaining edge 140 of boss 138.

The bars 122 can also be installed in the position shown in FIG. 43-*c*. In this position, the bar has been turned half a turn in clockwise direction with respect to the position shown in FIG. 43-*b*. The panels 154 are again installed from the exterior of the building wall by first inserting the lower edge of the panel in the subjacent bar in accordance with the arrow 168, such that this lower edge will become anchored by the prongs 132 and then the upper edge of the panel is pushed against prongs 130 in the direction of arrow 166.

The same bar 122 can also be fixed in either one of the positions shown in FIGS. 43*a* and 43*b* for the installation of the panels 154 from the inside of the building in accordance with arrows 170. In the position of FIG. 43-*a*, one starts to anchor the lower edge of the panel 154 in accordance with arrow 168, whereas in the position of FIG. 43-*d*, one starts by anchoring the top edge of the panel in accordance with arrow 164.

I claim:

1. A sheet metal element with a flat portion having a first and a second face and provided with a prong struck out from said flat sheet metal portion which has a resultant similarly shaped opening, said prong of elongated shape with a pointed free end, teeth protruding from at least one side and having an inner end integral with said sheet portion about a bending line transverse to said prong, bendable between an operative position generally normal to said sheet portion and on one side of the latter from an inoperative position nearly parallel to said sheet portion, characterized in that said prong, in its inoperative position, protrudes from said first face and has a part which overlaps an edge of said opening, such that this prong cannot be bent through said opening, because said part then abut against said opening edge.

2. A sheet metal element as defined in claim 1, further including a stop integral with said prong and protruding from said first face in the zone of said bending line and abutting against said sheet portion in the operative position of said prong.

3. A sheet metal element as defined in claim 2, wherein said pointed end has an extension which forms said part.

4. A sheet metal element as defined in claim 1, further including two stops integrally formed with said prong and with said sheet portion, respectively, on each side of said bending line and in the vicinity of the latter, said two prongs abutting each other in the operative position of said prong.

5. A sheet metal element as defined in claim 1, wherein said prong has a longitudinal reinforcing rib protruding from said first face and having an inner end in the vicinity of said bending line and forming a stop abutting against said sheet portion in the operative position of said prong.

6. A sheet metal element as defined in claim 1, wherein said prong has a longitudinal central reinforcing rib with an inner end located in the vicinity of said bending line, said rib protruding from said first face, said rib inner end abutting against said sheet portion in the operative position of said prong, each longitudinal edge of said prong having teeth, said teeth inclined with respect to said sheet portion and extending through said opening in the inoperative position of said prong, said prong having a width which decreases in the direction of said bending line.

7. A sheet metal element as defined in claim 6, wherein said pointed end has an extension which forms said part.

8. A sheet metal element as defined in claim 7, further including two stops integral with said prong and with said sheet portion, respectively, protruding from said first face and located on each side of said bending line adjacent the latter, said two stops engaging each other in the operative position of said prong.

9. A sheet metal element as defined in claim 1, forming a stud for a hollow wall, said stud having a cross-sectional U-shape, defining a web and two legs against which dry wall panels are adapted to be fixed with said web normal to said dry wall panels, said sheet portion constituting said web, said prongs arranged in pairs spaced longitudinally of said stud, the prongs of each pair protruding from opposite faces of said web in their inoperative position, such that said prongs can be only bent in opposite directions with respect to said web and extend on each side of said web in their operative position.

10. A sheet metal element as defined in claim 9, wherein the longitudinal axis of each prong is inclined with respect to the longitudinal axis of said stud.

11. A sheet metal element as defined in claim 10, wherein said bending line is inclined with respect to the longitudinal axis of said stud and to the longitudinal axis of said prong.

12. A sheet metal element as defined in claim 9, wherein the longitudinal axis of said prong is parallel to the longitudinal axis of said stud and said bending line is transverse to said stud longitudinal axis, said prong having teeth on each of its longitudinal edges the width of said prong decreasing in the direction of said bending line and said longitudinal edges and teeth being inclined with respect to the plane of said web and extending through said opening in the inoperative position of said prong.

13. A sheet metal element as defined in claim 1, forming a generally rectangular plate provided with means to fix said plate against a structural post of a hollow wall structure.

14. A sheet metal element as defined in claim 13, wherein said plate has a pair of said prongs located generally at the same level relative to the length of said plate, said prongs having teeth on only one of their longitudinal sides, the teeth of any one prong extending towards the other prong, the longitudinal axes of said prongs of said pair diverging in the direction of the pointed end of said prongs.

15. A sheet metal element as defined in claim 6, forming a generally rectangular plate, with the longitudinal axis of said prong located lengthwise of said plate.

16. A sheet metal element as defined in claim 1, forming a generally rectangular plate with at least two prongs located at the same level lengthwise of said plate, said two prongs diverging in the direction of their pointed ends when in inoperative position, each prong having teeth located only on that one of its longitudinal sides which faces the other prong, each prong provided with a stop protruding from said first face in the zone of said bending line, said plate provided with hooks spaced along its longitudinal axis, adapted to enter apertures made in the sheet metal structural studs of a hollow wall.

17. A sheet metal element as defined in claim 9, wherein the teeth of each prong of said pair are disposed on only one longitudinal side of the prong and face in the same direction.

18. A sheet metal element as defined in claim 17, further including an additional pair of prongs in the vicinity of the first-mentioned pair of prongs and similar to the latter, except that their teeth are directed in a direction opposite to the teeth of the prongs of the first pair.

19. A sheet metal element as defined in claim 1, in the form of an elongated bar, of Z-shaped cross-section, including a web and two oppositely-directed flanges depending from the opposite sides of the web, one flange being a prong-free flange, said web and the other flange provided with said prongs longitudinally spaced along the same, the prongs depending from said web extending in the same direction as said prong free flange and the prongs depending from said other flange extending in the same direction as said web with respect to said other flange, in the operative positions of said prongs.

* * * * *